United States Patent [19]

Myers

[11] Patent Number: 5,022,828

[45] Date of Patent: Jun. 11, 1991

[54] COOLER FAN ORIFICE ASSEMBLY

[75] Inventor: Wayne K. Myers, Loraine, Ill.

[73] Assignee: Cooper Industries, Inc., Houston, Tex.

[21] Appl. No.: 419,769

[22] Filed: Oct. 11, 1989

[51] Int. Cl.[5] ..... F04B 35/00

[52] U.S. Cl. ..... 417/362; 62/507

[58] Field of Search ..... 417/361, 362; 62/507

[56] References Cited

U.S. PATENT DOCUMENTS

| | | | |
|---|---|---|---|
| 1,918,981 | 7/1933 | Peltier | 62/507 |
| 1,953,473 | 4/1934 | Fedders | 62/507 |
| 2,403,528 | 7/1946 | Higham | 62/507 |

*Primary Examiner*—Robert G. Nilson

*Attorney, Agent, or Firm*—Laff, Whitesel, Conte & Saret

[57] ABSTRACT

A cooler fan orifice assembly and a cooler fan orifice ring for adjusting the tension of a fan belt of a compressor. The assembly includes a motor mount section having a generally rectangular frame and having an adjustable mechanism that is connected to the fan orifice ring and the compressor motor, the adjustable mechanism causing the motor and the fan orifice ring to slideably move together so that the tension of the fan belt can be changed without dissembling the motor, orifice ring and guard.

12 Claims, 4 Drawing Sheets

COOLER FAN ORIFICE ASSEMBLY

FIELD OF THE INVENTION

This invention relates to a cooler fan orifice assembly. More particularly, this invention relates to a cooler fan orifice assembly having an orifice fan ring, orifice fan guard and motor slide base that permits the adjustment of fan belt tension without dismantling component parts.

BACKGROUND OF THE INVENTION

A variety of commercial compressors are known. Many industries, commercial businesses and residential homes utilize compressors for water pumps, air-conditioning units and the like. Because of the great demand for compressors, the compressor industry constantly strives to improve the durability and quality of operation of the compressor.

There are presently available compressors that operate fairly efficiently and which are moderately durable. These existing compressors generally have well-made components which greatly increases the life of these compressor. However, even the highest quality of these compressors require periodic maintenance and replacement of old or malfunctioning component parts. A common compressor maintenance problem is that the fan belts become loose after use and require periodic tension adjustment. However, tension adjustment of the fan belts is extremely time consuming and usually creates additional problems. The additional problems created by tension adjustment to the fan belts involve the dismantling of component parts and are better understood given an understanding of the structure of a compressor.

A typical compressor includes an assortment of component parts which are extremely compact and close fitting. For example, the fan belt is generally centrally located between the fan guard and motor on one side and the fan orifice ring, cooler fan and cooler on the other side. These component parts are concentrically aligned around the hub of the motor and accordingly, this concentric alignment, coupled with the extremely close fit between the component parts, prohibits even a slight variation from the normal positions of the parts to maintain proper compressor operation.

However, despite the above-described structural limitations of existing compressors, maintenance procedures require that various component parts be dismantled to effectuate tension adjustments of the fan belt. The dismantling of component parts to adjust the fan belt is necessary because the fan belt is positioned centrally between a plurality of component parts and is not accessible without removal of other parts. Thus, when the fan belt malfunctions due to loose tension of the belt and requires tension adjustment, numerous component parts must be removed to provide access to the fan belt. For example, the tension adjustment of the fan belt requires, in part, dismantling and removing the orifice fan guard and the orifice fan ring. The removal of parts to adjust the tension of the fan belt necessitates reassembly of the parts back to their original state. It is often reassembly of the parts which causes other compressor problems including, but not limited to: improper alignment of parts; improper assembly and replacement of parts; and damage to parts caused by repeated removal and reassembly. Moreover, the reassembly of the parts is extremely time consuming and often very expensive, especially in the case of industries which depend upon a properly functioning compressor.

SUMMARY OF THE INVENTION

The present invention, by contrast with the above-mentioned compressor designs, is concerned primarily with providing the motor of a compressor with a cooler fan orifice assembly that effectively eliminates the need for disassembly of component parts to increase the tension of the fan belt. Should the fan belt of the compressor require an adjustment for tension, the belt may be adjusted without the need for disassembly of the component parts. Instead, the motor, the fan guard and fan orifice ring of the compressor may be moved by laterally sliding the motor and the fan orifice ring over a motor slide base in either direction. The sliding movement of the motor, along with the fan orifice ring, over the motor slide base causes a sheave, which is connected to the motor, to laterally move with respect to a drive sheave. The fan guard also is caused to laterally move as it is attached to the fan orifice ring. This lateral movement of the sheave adjusts the tension of the fan belt without disassembly of the component parts of the compressor.

Accordingly, an object of the present invention is to provide a cooler fan orifice assembly for a compressor that eliminates the need for disassembly of component parts during adjustment of the tension of the fan belt of the compressor.

Another object of the present invention is to provide a cooler fan orifice assembly that maintains the proper alignment of the component parts subsequent to the tension adjustment of the fan belt.

Another object of the present invention is to provide a cooler fan orifice assembly that adjusts the tension of the fan belt without necessitating the loosening of fasteners to facilitate the relative movement between the fan and the cooler when the motor is moved to adjust the belt.

A further object of the present invention is to provide a cooler fan orifice ring that maintains good fan efficiency by providing means to move the orifice ring with a motor and without the necessity of tedious position adjustment each time a fan belt is adjusted.

A further object of the present invention is to provide a cooler fan orifice assembly allows for the cooler and associated piping extending therefrom to remain stationary while the motor, fan guard, and orifice ring are movable for belt tensioning.

In the preferred embodiment, the invention comprises a motor slide base which is attached to the underside of the compressor motor and the stem of the fan orifice ring. The cooler fan and sheave are installed on the motor hub. A guard is attached to the fan orifice ring and moveable therewith. The orifice ring directs air flow through the cooler. The fan belt is secured in part, by the sheave. The tension of the fan belt may be adjusted by causing the sheave to laterally slide. The sheave is caused to move by laterally sliding the motor over the motor slide base. Because the sheave extends into the fan orifice ring, the fan orifice ring is adapted to also laterally slide over the motor slide base. The direction in which the motor laterally moves is determined by whether the fan belt is tightened or loosened. Generally, the fan belt requires tightening of the tension since repeated use of the belt tends to loosen same. In the preferred embodiment, lateral movement of the motor and the stem of the fan orifice ring over the motor slide base is accomplished by turning two lead bolts or screws in the motor slide base.

In the preferred embodiment, therefore, the tension adjustment of the fan belt is accomplished by turning lead screws in the motor slide base to laterally slide the motor and base of the fan orifice ring over the motor slide base until the desired belt tension is obtained. The fan belt is thus quickly and easily maintained and adjusted for proper tensioning without dismantling component parts by only turning the motor slide base adjusting screws.

BRIEF DESCRIPTION OF THE DRAWINGS

The inventive device will become more apparent from the following description taken in conjunction with the attached drawings illustrating the preferred embodiment wherein.

DETAILED DESCRIPTION OF THE INVENTION

Figure 1:
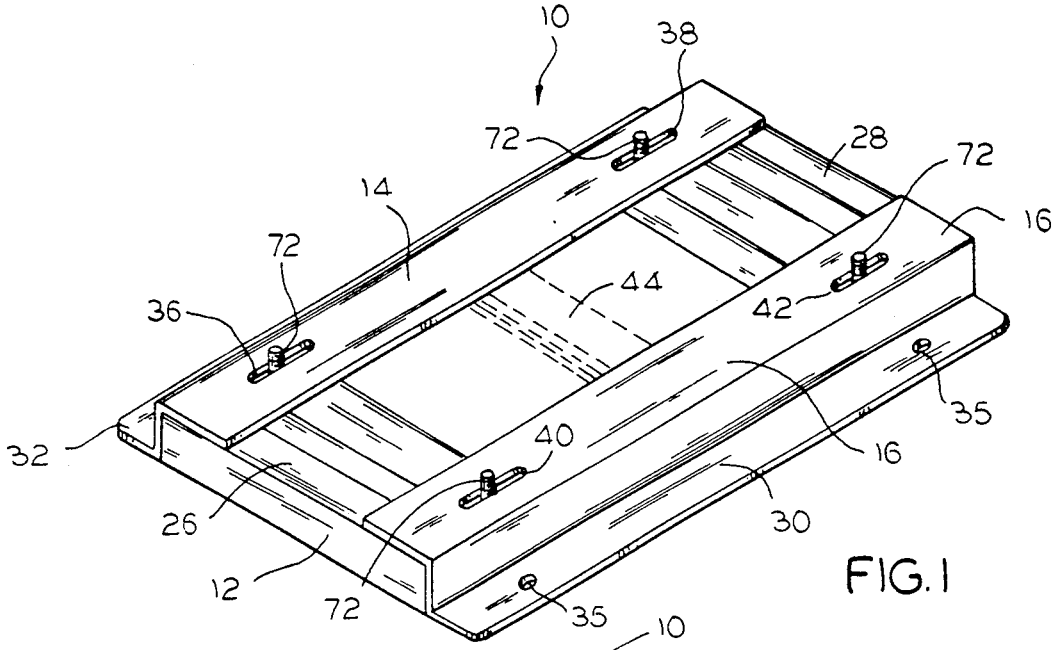
FIG. 1 is a perspective view of the motor slide base use in the present invention.

The invention provides, in part, a motor slide base 10, a fan orifice ring 76 and fan orifice guard 78. (FIGS. 1–9). Fan orifice ring 76 is generally oblong and includes, in part, a stem portion or motor mount section 74 which extends over and is attached to the top of motor slide base !0. A compressor motor 18 rests on top of motor mount section 74 of fan orifice ring 76 and motor slide base 10. Fan orifice guard 78 is attached to fan orifice ring 76. Motor slide base 10, which is commercially purchased and readily available, has, in part, a generally rectangular body 12, support pieces 14, 16 for the compressor motor 18 and the motor mount section 74 of fan orifice ring 76, and lead screws, 20,22 for adjusting the tension of fan belt 24 of a compressor (not shown). The tension of fan belt 24 may be increased or decreased by adjusting the lead screws 20,22 and causing the compressor motor 18, along with fan orifice ring 76 and fan orifice guard 78 and other component parts, to laterally move in either direction.

Figure 6:
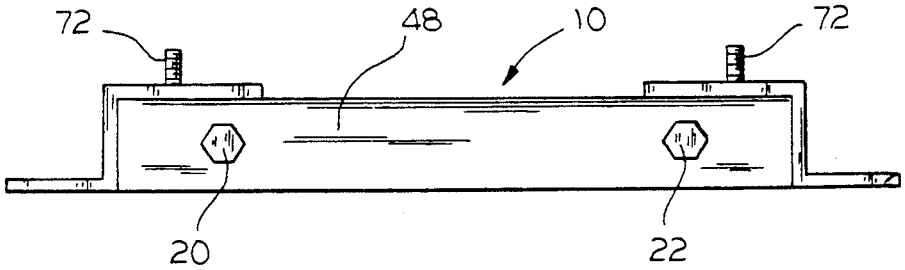
FIG. 6 is a side view of the motor slide base of FIG. 4.

Referring to FIG. 1, the motor slide base 10 has a generally rectangular body 12 formed by two support pieces 14,16 and two connecting pieces 26,28. The body has approximately a 2.00 to 3.00 inch depth, a 17 $\frac{3}{4}$ to 31 $\frac{1}{4}$ inch length and a 10 $\frac{3}{4}$ to 29 $\frac{3}{4}$ inch width excluding the flanges 30,32 or a 15 to 35 $\frac{1}{4}$ inch width including the flanges 30,32. Flanges 30,32 extend outwardly from the sides of the support pieces 14,16 and are used to secure the motor slide base 10 to a compressor floor 34 with bolts (not shown) through bolt holes 35, as shown in FIG. 6. Support pieces 14,16 each have two slits 36,38 and 40,42, respectively. Slits 36,38,40,42 are each approximately 4 to 7 $\frac{1}{2}$ inches in length and are wide enough to receive a bolt that is approximately $\frac{1}{2}$ to $\frac{3}{4}$ inches in width and 1.75 to 3.00 inches in length. In another embodiment, a gusset 44 extends across the width of motor slide base 10 and connects support pieces 14,16. Gusset 44 also provides additional support for compressor motor 18 as it appears in FIG. 1.

Figure 2:
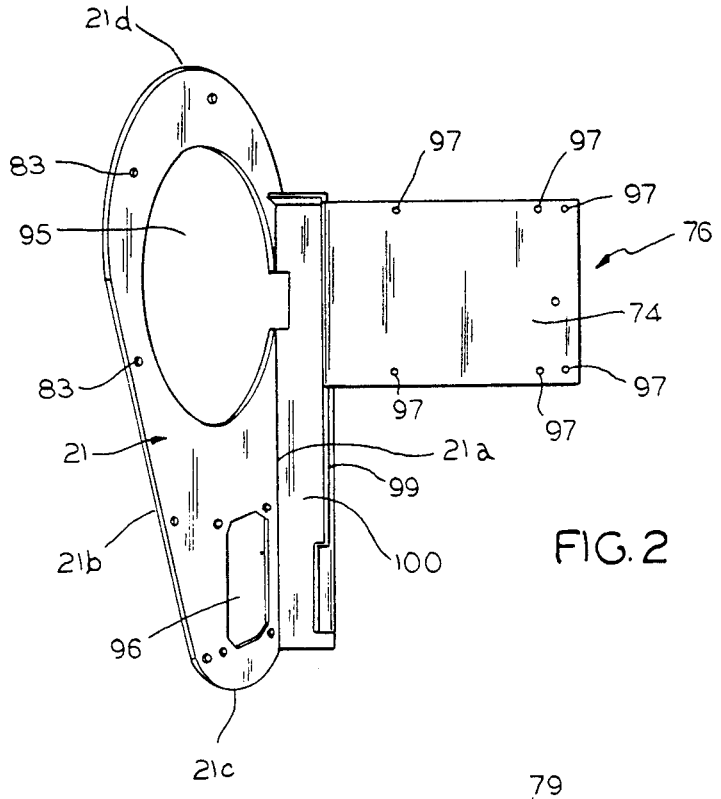
FIG. 2 is a perspective view of the fan orifice ring used in the present invention.

Referring to FIG. 2, the fan orifice ring 76 has a generally oblong body having a fan encasing wall 21, a base well section 100, and a motor mount section 74. The wall 21 is oblong shaped with a base 21*a*, a hypotenuse side 21*b*, a first side 21*c* and a second side 21*d*. The sides 21*c* and 21*d* both have arcuate segments with the arc of side 21*c* preferably being at least 20° and the arc of 21*d* being at least 90°. The encasing wall 21 includes a large first opening or fan orifice 95 which is adapted to enclose the cooler fan 82 (see FIG. 8) and a smaller second fixed drive sheave opening or orifice 96 which receives second sheave 92. Opening 96 is rectangular in shape and is approximately 9.00 inches in length and 7.00 inches in height.

The wall section 100 extends substantially the length of the wall 21 and is U-shaped. One side of the "U" is the encasing wall 21 and the other side is a wall 99. Wall 99 may have varying heights or the same height throughout. This depends on the configuration of the motor and the fixed drive sheave orifice 96. In the embodiment shown, the height of the wall 99 adjacent the fan orifice and sheave orifice 96, does not have the same height throughout.

The motor mount section 74 extends outwardly from and perpendicularly to encasing wall 21 and wall 99. The height and length of section 74 is determined such that when the ring 76 is in its desired position, section 74 rests on top of motor slide base 10 and serves to additionally support compressor motor 18. Section 74 has holes 97 that are sized and spaced the same distance from each other as the motor mounting holes. Motor mount section 74 is attached to motor slide base 10 through holes 97 by bolts 72 (see FIG. 7). As shown in FIG. 2, the centerline 101 of motor mount section 74 is equidistant between bolts 97 and is parallel to the longitudinal axis of compressor motor 18 when motor 18 is mounted on the motor slide base 10 and motor mount section 74. It is preferred that the longitudinal axis of compressor motor 18, as mounted, pass through the center of fan orifice 95. Thus, fan orifice ring 76 moves with compressor motor 18.

Fan orifice guard 78 is attached to fan orifice ring 76 along its perimeter by appropriate means i.e. welded nuts, through the appropriate corresponding holes and bolts.

Figure 3:
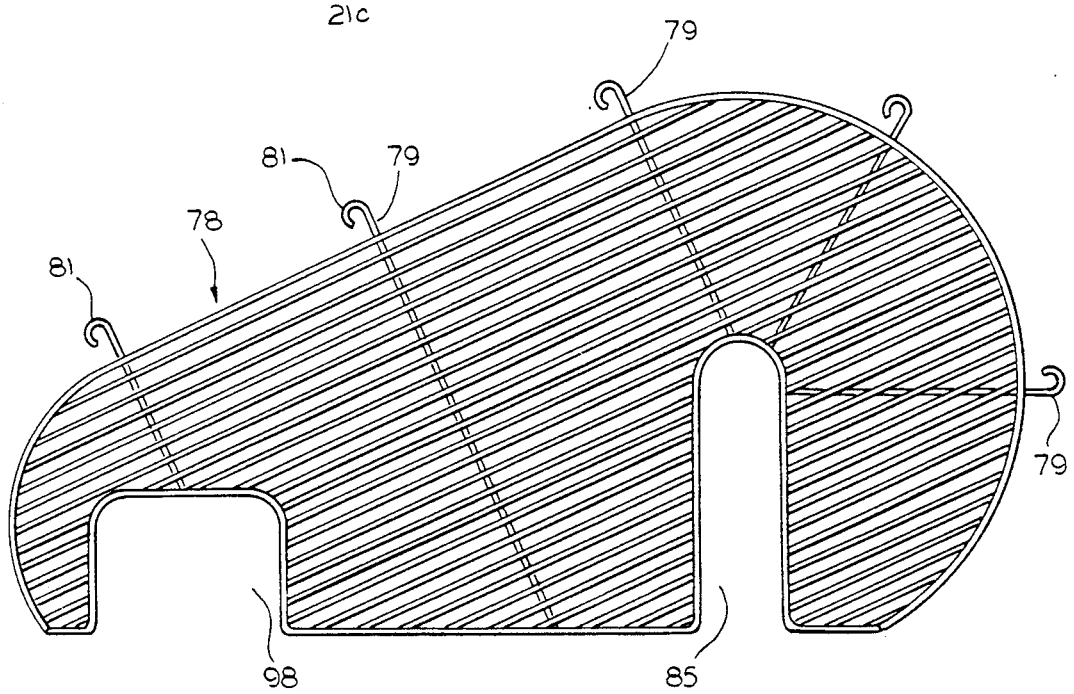
FIG. 3 is a plan view of the fan orifice guard that is attached to the fan orifice ring of FIG. 2.

As shown in FIG. 3, fan orifice guard 78 is similar in shape to fan orifice ring 76 and includes a plurality of reinforcement rods 79 having hooked ends 81 for rotatably attaching bolts 85 to bolt holes 83 of orifice fan ring 76. (see FIG. 2). Fan orifice guard further includes an elongated first opening 85 into which fits motor drive shaft 84. Fan orifice guard 78 also includes a rectangular second opening 98 which coincides with second opening 96 of fan orifice ring 76. Both first opening 85 and second opening 98 of fan orifice guard 78 have three sides with the fourth side being open along the perimeter of the guard 78.

Figure 4:
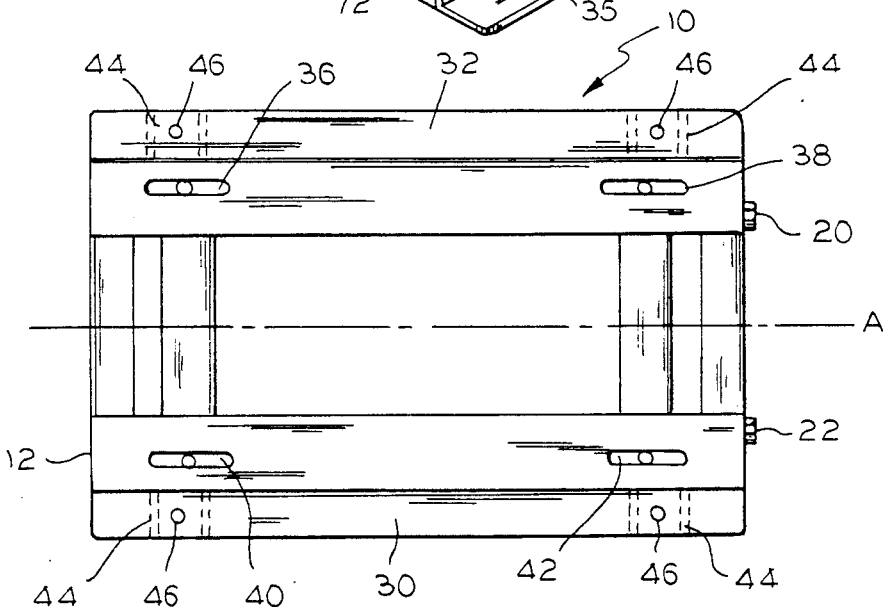
FIG. 4 is a plan view of the top of the motor slide base of FIG. 1.

Referring to FIG. 4, the side adjacent to connecting piece 26 includes two lead screws 20,22 that extend beneath the motor slide base 10, in a direction parallel to the support pieces 14, 16, which will be explained in greater detail later. The lead screws 20,22 are each be spaced 4 1/10 to 12½ inches from central axis A, as shown in FIG. 4.

In another embodiment, motor slide base 10 also may include braces 44. Braces 44 would be secured to motor mount base 10 by the bolt holes 46 identified in FIG. 1. Braces 44 are spaced at a distance from each other of 10 to 18 inches, as measured from the inside of each brace 44 and on the same side of the motor slide base 10, or 12 ½ to 22 inches, as measured from the bolt holes 35 of each of braces 44. Braces 44 also must be a distance of 6 3/5 inches to 16 ¼ inches from central axis A, as shown in FIG. 4.

Figure 5:
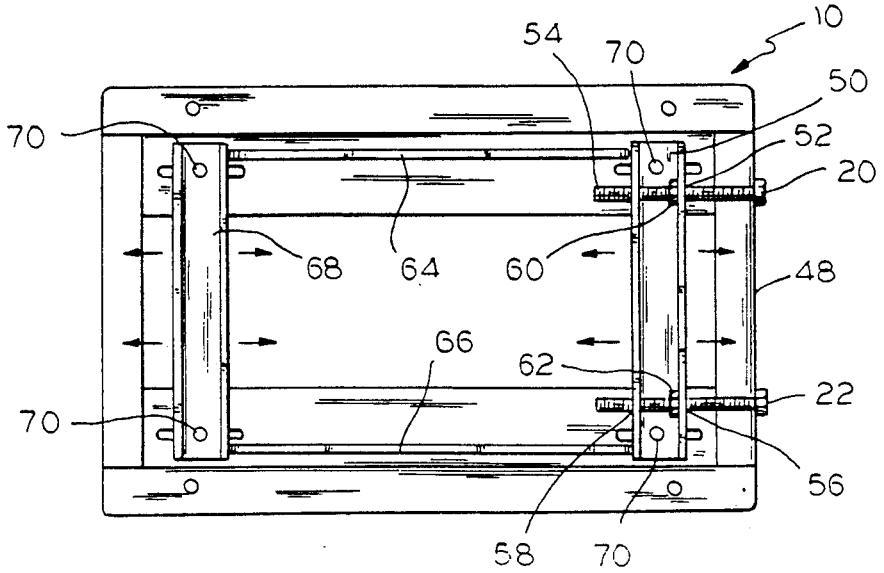
FIG. 5 is a plan view of the bottom of the motor slide base of FIG. 1.

FIGS. 5 and 6 show the lead screws 20,22 as attached to motor slide base 10. As FIG. 5 shows, lead screws 20,22 are attached to motor slide base 10 at the side 48. The lead screws extend below the support pieces 14,16 depicted in FIGS. 1 and 4 and into a first inverted U-shaped bracket 50 through openings 52,54 and 56,58. Nuts 60,62 are welded to the inverted U-shaped bracket 50. Two interconnecting pieces 64,66 connect inverted U-shaped bracket 50 to a second inverted U-shaped bracket 68. Both the first inverted U-shaped bracket 50 and the second inverted U-shaped bracket 68 have openings 70 for bolts 72 (see FIG. 7) that will connect compressor motor 18 to motor slide base 10.

As the arrows in FIG. 5 indicate, both the first inverted U-shaped bracket 50 and the second inverted U-shaped bracket 68 are laterally slideably moveable in whatever direction is desired. Thus, when lead screws 20,22 are turned, the first bracket 50 is caused to move and a second bracket 68 which is attached to first bracket 50 by interconnecting pieces 64,66, is also caused to move. The direction which lead screws 20,22 are turned dictates the direction in which the first and second brackets 50,58 move.

Figure 7:
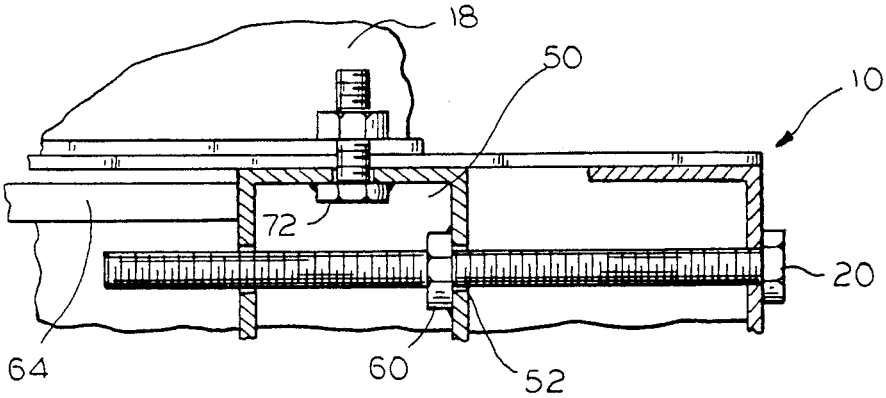
FIG. 7 is a fragmentary cross-sectional view of an adjusting screw of the motor slide base of FIG. 4.

FIG. 7 shows the first bracket 50 and demonstrates the position of the inverted U-shape of bracket 50. The bottom portion of the U-shape of bracket 50 contacts the top of motor slide base 10. As FIG. 7 further shows, a bolt 72 extends from the compressor motor 18 into the motor mount section 74 of fan orifice ring 76 and motor slide base 10 through opening 70 and into the first inverted U-shaped bracket 50. Bolt 72, which is welded to both compressor motor 18 and the first bracket 50, serves to not only connect the compressor motor 18 and motor mount section 74 of fan orifice ring 76 to motor slide base 10 but to also connect the compressor motor 18 and motor mount section 74 to the first bracket 50. Because compressor motor 18 is attached to first bracket 50, any movement of first bracket 50 will also cause the same movement of compressor motor 18 and motor mount section 74 of fan orifice ring 76. Compressor motor 18 is also attached to first bracket 50 at a second opening 70 and similarly to second bracket 68 at openings 70. As explained in reference to FIG. 5, the turning of lead screws 20,22 will cause first bracket 50, interconnecting pieces 64,66 and second bracket 68 to move in the same direction. Because compressor motor 18, along with stem portion 74 of fan orifice ring 76, is attached to first and second brackets 50,68 by bolt 72 through openings 70, compressor motor 18 and orifice ring 76 will also move in the same direction as first and second bracket 50,68.

Referring again to FIG. 1, bolts 72 are shown as they would appear prior to attachment to compressor motor 18. As FIG. 1 indicates, bolts 72 fit into slits 36,38,40,42 of support pieces 14,16. Because slits 36,38,40,42 extend lengthwise on support pieces 14,16, bolts 72 are capable of freely moving laterally within slits 36,38,40,42 in either direction. Accordingly, when compressor motor 18 and stem portion 74 of fan orifice ring 76 are positioned on top of motor slide base 10 (as shown in FIG. 8) and are attached by bolts 72 to first and second brackets 50,68, the compressor motor 18 and fan orifice ring 76 will also be laterally slideably moveable within slits 36,38,40,42.

Figure 8:
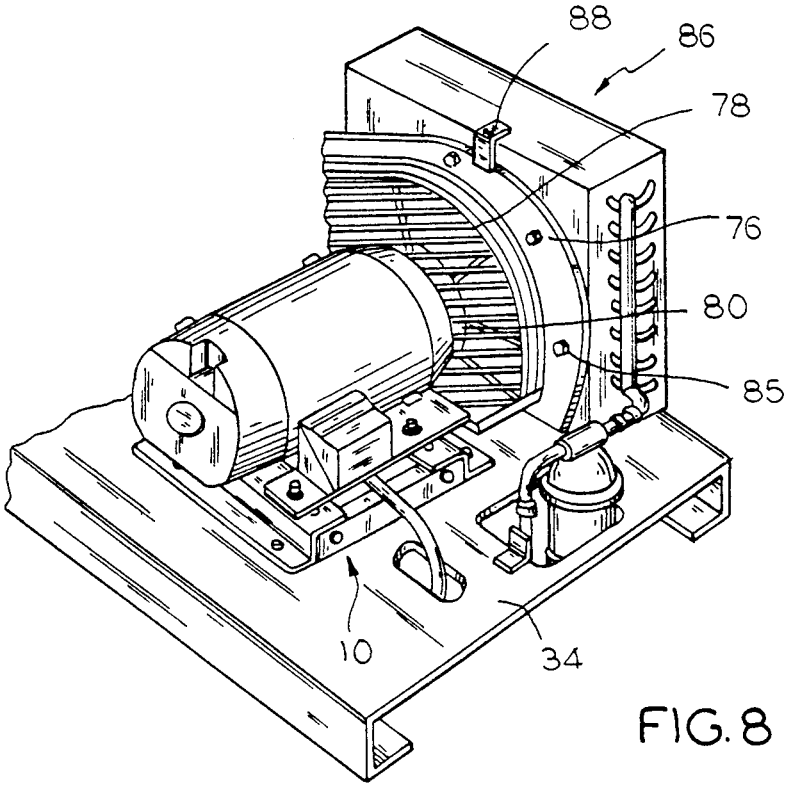
FIG. 8 is a perspective view of a compressor motor mounted on the motor slide base.

FIG. 8 shows the motor slide base 10 as it appears assembled with the compressor motor 18 and other component parts. As shown, the motor slide base 10, along with other component parts of the compressor motor 18 rests on and is attached to support 34 by bolts 35. Directly above and attached to motor slide base 10 is the stem portion 74 of fan orifice ring 76. Compressor motor 18 rests on top of stem portion 74 of fan orifice ring 76 and motor slide base 10. Fan orifice ring 76, fan guard 78, sheave 80 and cooler fan 82 are connected to and concentrically aligned with motor drive shaft 84 as shown in FIG. 7. Cooler fan 82 rotates inside of a large first opening 95 of fan orifice ring 76 and around a hub post 83 of sheave 80. Cooler 86 is centrally positioned behind fan orifice ring 76.

Cooler 86 includes holding bracket 88 which secures but allows lateral movement of fan orifice ring 76 against cooler 86. Lateral movement of fan orifice ring 76 is necessary because, as previously explained, fan orifice ring 76 is connected to motor hub 84 of compressor motor 18 and by motor mount section 74 to motor slide base 10. Because turning lead screws 20, 22 causes movement of first and second brackets 50,68, and motor 18, all of the component parts attached to both motor drive shaft 84 of motor 18 and to motor slide base 10 also move laterally, including the fan orifice ring 76. Accordingly, bracket 88 not only must secure fan orifice ring 76 to cooler 86 but also must permit lateral movement of fan orifice ring 76.

Figure 9:
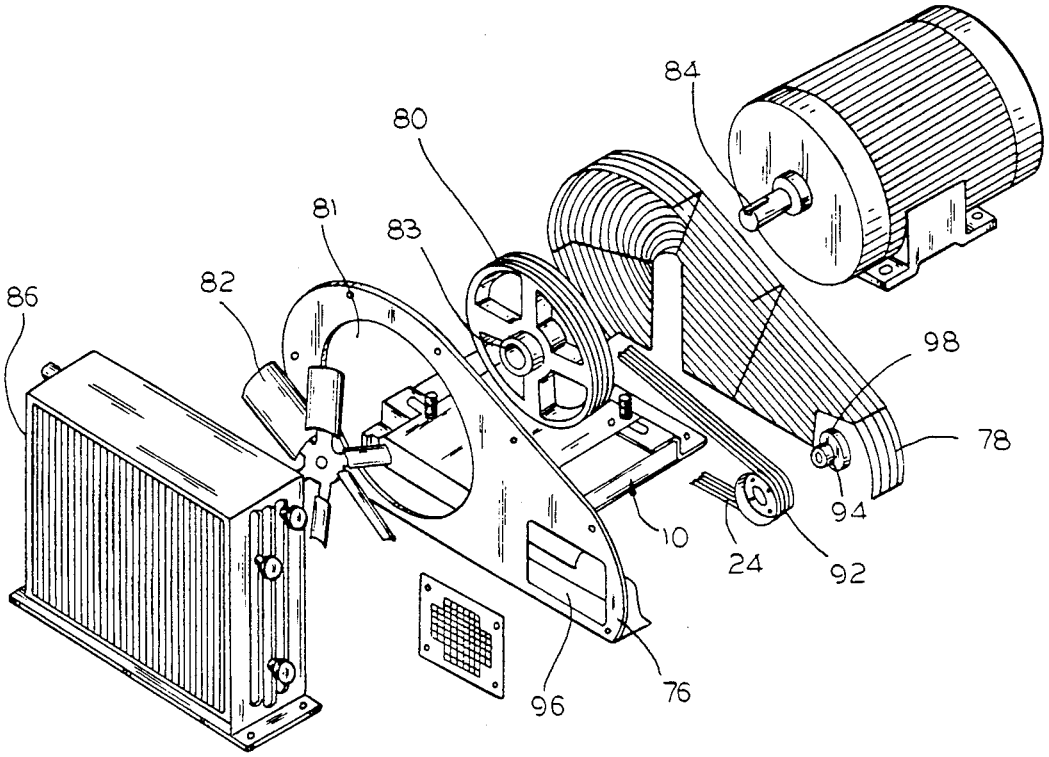
FIG. 9 is an exploded perspective view showing the disassembled parts of FIG. 8 and their relationship to each other.

FIG. 9 shows in greater detail the interrelationship of the component parts and the manner in which they are concentrically aligned around motor drive shaft 84. Sheave 80, rotates about motor drive shaft 84 and retains fan belt 24 at one end. Fan belt 24 is retained at its other end by a second sheave 92 which is rotatably attached to a second hub 94. Second hub 94 is not attached to orifice fan ring 76 or orifice fan guard 78 but is attached to stationary piping (not shown) of the compressor (not shown). Orifice fan ring 76 and orifice fan guard 78 each have a opening, 96 and 98, respectively, which allows for lateral movement of both components without contacting or interfering with second sheave 92 or second hub 94.

The tension of fan belt 24 is dictated by the distance between sheave 80 and second sheave 92. The greater the distance between sheave 80 and second sheave 92, the greater the tension of fan belt 24. Accordingly, the tension of fan belt 24 may be adjusted by turning the lead screws 20,22 in either direction, to cause the compressor motor 18 and fan orifice ring 76, and all component parts attached to the motor drive shaft 84, including sheave 80, to laterally move in the desired direction. If the fan belt 24 becomes too loose and an increase in its tension is desired, the lead screws 20, 22 may be turned in a direction which causes the first and second brackets 50, 68 to move in a direction which moves motor slide base 10 and motor 18 away from the stationary second sheave 92. When motor 18 moves away from second sheave 92 all other component parts attached to the motor 18, including sheave 80, move away from second sheave 92 and therefore, cause the tension in fan belt 24 to increase.

While certain parts of the motor slide base 10 and some of the components of compressor motor 18 have been described in terms of precise measurements and others in terms of approximate measurements, it should be understood that the size of the motor slide base 10 and other components may vary according to need. Thus, there may be a plurality of sizes of motor slide bases 10. The sizes can vary, but are limited to the manufacturing equipment's capabilities.

The materials from which motor slide base 10 are constructed include any sturdy metal material, including aluminum, steel and the like. The material used for the motor slide base 10 is generally the material used to manufacture the other component parts of the compressor motor 18.

Therefore it should be recognized that, while the invention has been described in relation to a preferred embodiment thereof, those skilled in the art, may develop a wide variation of structural details without departing from the principles of the invention. Therefore, the appended claims are to be construed to cover all equivalents falling within the true scope and spirit of the invention.

The invention claimed is:

1. A cooler fan orifice assembly for adjusting the tension of a compressor fan belt comprising a motor slide base and a fan orifice ring, said motor slide base having a generally rectangular frame and having adjusting means that are connected to said fan orifice ring and a compressor motor, said adjusting means causing said motor and said fan orifice ring to slideably move within an elongated slot on said motor slide base, said lateral movement of said motor within said slot causing a change in the tension of said fan belt.

2. The assembly of claim 1 wherein said adjusting means include at least one lead screw that extends through an opening in said motor slide base and into an inverted U-shaped bracket.

3. The assembly of claim 1 wherein said compressor motor and said fan orifice ring are connected to said adjusting means by a bolt that extends through said elongated slot of said motor slide base and into an inverted U-shaped bracket.

4. The assembly of claim 1 wherein one end of said fan belt is attached to a first sheave, said first sheave being attached to a hub of said compressor motor, and the other end of said fan belt is attached to a second sheave, said second sheave being attached to a non-movable structure of said compressor.

5. The assembly claim 4 wherein said tension of said fan belt is increased when said first sheave is slideably moved in a direction away from second sheave, said first sheave being attached to said motor hub and slideably moveable responsive to said adjusting means.

6. A cooler fan orifice assembly for adjusting the tension of a fan belt of a compressor comprising a motor slide base and a fan orifice ring, said motor slide base having a generally rectangular frame having adjusting means that are connected to said fan orifice ring and a compressor motor, said adjusting means extending through an opening in said motor slide base and said fan orifice ring and into an inverted U-shaped bracket, said adjusting means causing said motor and said fan orifice ring to slideably move within an elongated slot on said motor slide base, said lateral movement of said motor within said slot causing a change in the tension of said fan belt, said change in the tension of said fan belt is effectuated when the adjusting means move a first moveable sheave away from a second fixed drive sheave, said first moveable sheave being attached to said fan belt.

7. The assembly of claim 6 wherein said fan orifice ring has a fan blade encasing wall, a base well section and a motor mount section, a drive sheave orifice formed in said encasing wall adjacent a first side, a fan orifice found in said encasing wall adjacent a second side, means on the periphery of said encasing walls to attach a guard to said orifice ring, said well portion extending from the base of the encasing wall and having a width larger than the width of said moveable and fixed drive sheaves, said motor mount section extending from one side of said well section and having a width, length and height to lay on said motor slide base beneath said compressor motor, and means to attach said motor mount section to said motor and said cooler fan orifice assembly, said means moving said motor mount section and said fan orifice ring when said motor is moved by said adjusting means.

8. The assembly of claim 6 wherein said fan orifice ring has a section fan blade encasing wall, a base wall and a motor mount section;

a generally rectangular sheave orifice in said encasing wall adjacent said first side;

a fan orifice in said encasing wall adjacent said second side;

means spaced in a predetermined manner about the periphery of said encasing wall to provide means to attach a guard means to said fan orifice ring;

said well base section having a bottom wall extending a substantial portion of said encasing base and extending perpendicularly outward therefrom to provide a predetermined width, for said bottom wall;

a well side wall extending perpendicular to said base wall and substantially parallel to said encasing wall and spaced a predetermined distance from said encasing wall;

a substantially rectangular motor mount plate extending perpendicularly from said wall side wall;

said motor mount section having a height and length sufficient to support thereon the motor and to be supported by the motor mount section, spaced motor mount holes in said motor mount section being sized and spaced to coincide with said mounting holes in a motor base and mounting bolts of the motor mount section;

said motor mount section having a width less than the diameter of the fan orifice and has a center line whose perpendicular plane intersects the center of the fan orifice and a longitudinal axis of a drive shaft of said motor; and the width of said well portion being greater than the width of a first moveable sheave and a fixed drive sheave.

9. The assembly of claim 8 wherein said fan encasing wall is an oblong shape having an encasing base, a hypotenuse side at a predetermined angle to the base, said hypotenuse side joining said encasing base by a first side prior to forming an acute angle, said first side having an arcuate segment, a second side opposite the hypotenuse joining the hypotenuse and the encasing base, and said second side having an arcuate segment.

10. The assembly of claim 6 wherein said fan orifice ring has a fan blade encasing wall, a base well section and a motor mount section, a drive sheave orifice formed in said encasing wall adjacent a first side, a fan orifice found in said encasing wall adjacent a second side, means on the periphery of said encasing walls to attach a guard to said fan orifice ring, said well section extending from the base of the encasing wall and having a width larger than the width of said moveable and fixed drive sheaves, said motor mount section extending from one side of said well section and having a width, length and height to lay on said motor slide base beneath said compressor motor, and means to attach said motor mount section to said motor and said cooler fan orifice assembly, said means moving said motor mount section and said orifice ring when said motor is moved by said adjusting means.

11. The orifice of claim 10 wherein said fan orifice ring has a section fan blade encasing wall, a base wall and a motor mount section;

a generally rectangular sheave orifice in said encasing wall adjacent said first side;

a fan orifice in said encasing wall adjacent said second side;

means spaced in a predetermined manner about the periphery of said encasing wall to provide means to attach a guard means to said fan orifice ring;

said well base section having a bottom wall extending a substantial portion of said encasing base and extending perpendicularly outward therefrom to provide a predetermined width, for said bottom wall;

a well side wall extending perpendicular to said base wall and substantially parallel to said encasing wall and spaced a predetermined distance from said encasing wall;

a substantially rectangular motor mount plate extending perpendicularly from said wall side wall;

said motor mount section having a height and length sufficient to support thereon the motor and to be supported by the motor mount section, spaced motor mount holes in said motor mount section being sized and spaced to coincide with said mounting holes in a motor base and mounting bolts of the motor mount section;

said motor mount section having a width less than the diameter of the fan orifice and has a center line whose perpendicular plane intersects the center of the fan orifice and a longitudinal axis of a drive shaft of said motor; and the width of said well portion being greater than the width of a first moveable sheave and a fixed drive sheave.

12. A one-piece collar fan orifice ring comprising a fan blade encasing wall portion, a base wall portion and a motor mount portion, said fan encasing wall being an oblong shape having an encasing base, a hypotenuse side at a predetermined angle to the base, said hypotenuse joining said encasing base prior to forming an arcuate angle therewith by a first side having a first arcuate segment of at least 20°, a second side opposite the hypotenuse having an arcuate segment of at least 90°;

a cooling fan orifice ring in said encasing wall adjacent said second side;

a generally rectangular sheave orifice in said encasing wall adjacent said first side;

means spaced in a predetermined manner about the periphery of said encasing wall to provide means to attach a guard means to said cooling fan orifice ring;

a base wall portion having a bottom wall extending a substantial portion of said encasing base and extending perpendicularly outward therefrom to provide a predetermined width for said bottom wall;

a well side wall extending perpendicular to said base wall and substantially parallel to said encasing wall and spaced a predetermined distance from said encasing wall;

a substantially rectangular motor mount portion extending perpendicularly from said well side wall, said motor mount portion having a height and length sufficient to support thereon a motor having a rotary shaft, said motor and said motor mount portion supported by a motor mount base, said motor mount portion having spaced motor mount holes being sized and spaced to coincide with mounting holes in said motor mount base and mounting bolts of the motor mount portion;

said motor mount portion having a width less than the diameter of the cooling fan orifice-ring and having a center line whose perpendicular plane intersects the center of the cooling fan orifice ring and a longitudinal axis of the motor shaft when the motor is mounted thereon; and the width of said encasing wall portion being greater than the width of a moveable sheave and a fixed drive sheave.

* * * * *